US008291962B2

(12) United States Patent
Allsopp et al.

(10) Patent No.: US 8,291,962 B2
(45) Date of Patent: Oct. 23, 2012

(54) WINDOW COVERINGS

(75) Inventors: Reginald Allsopp, Stockport (GB); Antony Barnes, Stockport (GB)

(73) Assignee: Louver-Lite Limited, Hyde Cheshire (GB)

( * ) Notice: Subject to any disclaimer, the term of this patent is extended or adjusted under 35 U.S.C. 154(b) by 14 days.

(21) Appl. No.: 12/781,966

(22) Filed: May 18, 2010

(65) Prior Publication Data

US 2011/0126993 A1 Jun. 2, 2011

(30) Foreign Application Priority Data

May 27, 2009 (GB) ..... 0909053.1

(51) Int. Cl.
*A47H 13/00* (2006.01)

(52) U.S. Cl. ..... 160/383; 160/395; 160/393

(58) Field of Classification Search ..... 160/383, 160/382, 400, 401, 403, 384, 387, 393, 265, 160/270, 271, 368.1, 290.1, 405, 395
See application file for complete search history.

(56) References Cited

U.S. PATENT DOCUMENTS

| | | | | | |
|---|---|---|---|---|---|
| 1,780,913 | A * | 11/1930 | Golden | 160/387 |
| 1,782,905 | A * | 11/1930 | Mohun et al. | 160/387 |
| 1,792,853 | A * | 2/1931 | McConnell | 160/330 |
| 1,834,669 | A * | 12/1931 | Yeates | 160/263 |
| 3,524,491 | A * | 8/1970 | Olson | 160/393 |
| 4,246,952 | A * | 1/1981 | Helldorfer | 160/271 |
| 4,393,915 | A * | 7/1983 | Olson | 160/395 |
| 4,452,294 | A * | 6/1984 | Fukuchi | 160/395 |
| 4,499,937 | A * | 2/1985 | Waine et al. | 160/41 |
| 4,631,786 | A * | 12/1986 | Curry | 24/460 |
| 5,273,096 | A | 12/1993 | Thomsen et al. | |
| 5,368,084 | A * | 11/1994 | Hying et al. | 160/265 |
| 6,412,538 | B1 * | 7/2002 | Welfonder | 160/271 |
| 6,978,821 | B2 * | 12/2005 | Welfonder | 160/178.1 R |
| 7,131,481 | B2 * | 11/2006 | Varley et al. | 160/273.1 |
| 7,562,689 | B1 * | 7/2009 | Militello et al. | 160/84.04 |
| 8,016,013 | B2 * | 9/2011 | Horvath | 160/23.1 |
| 2004/0016519 | A1 * | 1/2004 | Welfonder | 160/178.1 R |
| 2005/0103451 | A1 | 5/2005 | Nien | |
| 2008/0035281 | A1 * | 2/2008 | Kirby | 160/265 |

FOREIGN PATENT DOCUMENTS

| | | |
|---|---|---|
| EP | 1669537 A2 | 6/2006 |
| EP | 1953333 | 8/2008 |
| GB | 2279686 | 1/1995 |
| GB | 2391577 A | 2/2004 |
| JP | 2002213158 | 7/2002 |
| WO | WO 2008/021166 | 2/2008 |

OTHER PUBLICATIONS

UK search report for United Kingdom application No. GB 0909053.1.

* cited by examiner

*Primary Examiner* — Katherine W Mitchell
*Assistant Examiner* — Johnnie A Shablack
(74) *Attorney, Agent, or Firm* — Wolf, Greenfield & Sacks, P.C.

(57) ABSTRACT

A fabric receiving element for a blind assembly, the fabric receiving element having at least two axially extending slots, each slot defining an opening for receiving blind material, the openings being of different respective widths, the slots including a floor opposite the openings, and wherein the middle portion of the floor of the slot is at a greater distance from the opening than the end portions of the floor of the slot.

10 Claims, 1 Drawing Sheet

WINDOW COVERINGS

RELATED APPLICATIONS

Foreign priority benefits are claimed under 35 U.S.C. §119 (a)-(d) or 35 U.S.C. §365(b) to United Kingdom Application No. GB 0909053.1, filed May 27, 2009, which is hereby incorporated by reference in its entirety.

BACKGROUND

1. Field

The present invention relates to a means for fixing blind material to a fabric receiving element. The invention particularly relates to a means for fixing blind material to a roller tube, head rail or a bottom bar, particularly in a roller blind.

2. Discussion of Related Art

Blinds such as roman blinds, roller blinds, vertical blinds, panel shades and the like typically comprise a blind substrate (e.g. a fabric material), the top edge of which being connected to a top member of the blind, such as a head rail or a roller tube, and the bottom edge being provided with a bottom bar.

Blinds are required for shielding windows (and other like openings) of a whole host of sizes. Accordingly, top members (such as roller tubes) and bottom bars of various lengths and diameters are available. Also, there is a demand for the blind manufacturer and end consumer to have a wide selection of blind materials available. In recent times the market requirement has seen a need for materials to become thicker due to specialist treatments such as blackout or specialty polymer coating. This is especially the case for screen fabrics, many of which are now required to provide reduced openness factors. This requires thicker yarn and results in thicker, heavier cloths.

Various techniques are employed for securing material to the top member or bottom bar. For example, GB 2279688 describes a roller for a roller blind which is adaptable for retaining materials of various thicknesses having slots of different sizes. However, in common with current designs of groove for top members and bottom bars, the shape of the slots in GB 2279688 is flat or is a curved downward arc at the bottom and has sharp angles which can hinder the movement of fabric within the slot when pressed into the form by the "plough" of the forming tool. This can make feeding the fabric into the slots difficult and may result in insufficient fabric being stored in the slot leading to fabric falling out of the slot. This problem is particularly an issue with thicker fabrics.

Also, prior to the instant invention, bottom bars adapted for retaining materials of various thicknesses were not known.

SUMMARY

This invention seeks to address or ameliorate the problems associated with the prior art by adapting the shape of the slot in order to assist movement of fabric within the slot and hence aid the feeding of the fabric into the slots. The invention also provides a bottom bar adapted for retaining materials of various thicknesses.

According to a first aspect of the invention, there is provided a fabric receiving element for a blind assembly, the fabric receiving element having at least two axially extending slots, each slot defining an opening for receiving blind material, the openings being of different respective widths, the slots including a floor opposite the openings, and wherein the middle portion of the floor of the slot is at a greater distance from the opening than the end portions of the floor of the slot.

According to a further aspect of the invention, there is provided a fabric receiving element for a blind assembly, the fabric receiving element having at least two axially extending slots, each slot defining an opening for receiving blind material, the openings being of different respective widths, the slots including a floor opposite the openings, and wherein the middle portion of the floor of the slot is concave relative to the opening and the end portions of the floor of the slot are convex.

For the avoidance of doubt, the floor of the slot is that portion of the slot which is directly opposite to the opening for receiving the blind material.

In use only one of the openings of the fabric receiving element will be used at any one time, i.e. that opening which is most appropriate for the thickness of blind fabric chosen.

The fabric receiving element has at least two axially extending slots, hence the fabric receiving element has at least two openings for receiving blind material, and at least two slots, wherein the middle portion of the floor of both slots is at a greater distance from the opening than the end portions of the floor of the slot.

Suitably the slots are of channel section and have two inwardly directed lips overhanging the channel to define the width of the opening available for receiving blind material.

Preferably all of the corners within the slot define an angle which is greater than 90 degrees, suitably 100 degrees or more, such as 100 to 145 degrees.

Preferably, all of the corners within the slot are rounded.

Preferably, the slot is substantially without joined surfaces.

The fabric receiving element is suitably a top member such as a roller tube or a head rail or a bottom bar, such as a roller tube or a bottom bar, especially a bottom bar, for example a bottom bar for a roller blind.

When the fabric receiving element is a top member such as a roller tube, the roller tube has at least two axially extending slots, for example two or three axially extending slots. Suitably, the slots are circumferentially spaced around the roller tube. Suitably, the slots are provided at regular spacings around the circumference of the roller tube.

When the fabric receiving element is a bottom bar, the bottom bar according to the invention has at least two axially extending slots, suitably two axially extending slots. Suitably, the slots are positioned substantially opposite one another in which case, when the bottom bar has two slots, there will be a top slot with a top opening and a bottom slot with a bottom opening. In use, the opening which is most appropriate for the thickness of blind fabric will be chosen, in which case the opening receiving the blind fabric will be the top opening and its respective slot will be the top slot and, where the bottom bar has two slots, the empty slot and opening will be the bottom slot and bottom opening respectively.

The invention suitably relates to a bottom bar. A bottom bar according to the invention suitably has a weight per metre of from 200 g to 400 g, such as around 300 g per metre, for example 306 or 308 g per metre.

According to a further aspect of the invention, there is provided a fabric receiving element for a blind assembly, suitably a roller blind assembly, the fabric receiving element having at least two axially extending slots, suitably, in the case of a top member, two or three axially extending slots and, in the case of a bottom bar, two axially extending slots, each slot defining an opening for receiving blind material, the openings being of different respective widths, and, preferably, the slots being of channel section and having two inwardly directed lips overhanging the channel to define the width of the opening available for receiving blind material, and wherein the middle portion of the floor of the slot is at a greater distance from the opening than the end portions of the floor of the slot, and, suitably, the middle portion of the floor of the slot is concave relative to the opening and the end portions of the floor of the slot are convex, and, preferably, all of the corners within the slot define an angle which is greater than 90 degrees, suitably 100 degrees or more, such as 100 to 145 degrees and, preferably, all of the corners within the slot are rounded and, preferably, the slot is substantially without joined surfaces.

According to a further aspect, the invention relates to a roller blind assembly, comprising a roller tube or a bottom bar, suitably a bottom bar, as described herein and blind material.

In preferred embodiments, the slots in the fabric receiving element are open ended and extend along the full length of the fabric receiving element.

Suitably, the openings of the slots have a width of the order of a few millimetres, typically less than 1 cm, such as in the range of about 2 to 5 mm, for example about 3.5 to 4 mm. The openings are of different respective widths and, preferably, the openings differ in width by about 0.5 to 3 mm, such as by about 0.5 to 1 mm.

Preferably, the fabric receiving element is made by extrusion. Suitably, the fabric receiving element is of metal, conveniently aluminium.

Suitably, when the invention relates to a bottom bar, the bottom bar is provided with end caps which attach to the two distal ends of the bottom bar and are adapted to fit the shape of the section of the bottom bar. Such end caps may be made of a suitable material, for example a plastic material.

The skilled person will appreciate that the features described and defined in connection with the aspects of the invention and the embodiments thereof may be combined in any combination, regardless of whether the specific combination is expressly mentioned herein. Thus, combinations of optional features are within the scope of the invention.

BRIEF DESCRIPTION OF THE DRAWINGS

An embodiment of the invention will now be described, by way of example only, with reference to the accompanying drawings in which.

DETAILED DESCRIPTION

For the avoidance of doubt, the skilled person will appreciate that in this specification, the terms "up", "down", "front", "rear", "upper", "lower", "width", "above", "below", etc. refer to the orientation of the components of the invention when installed for normal use as shown in the Figures.

Figure 2:
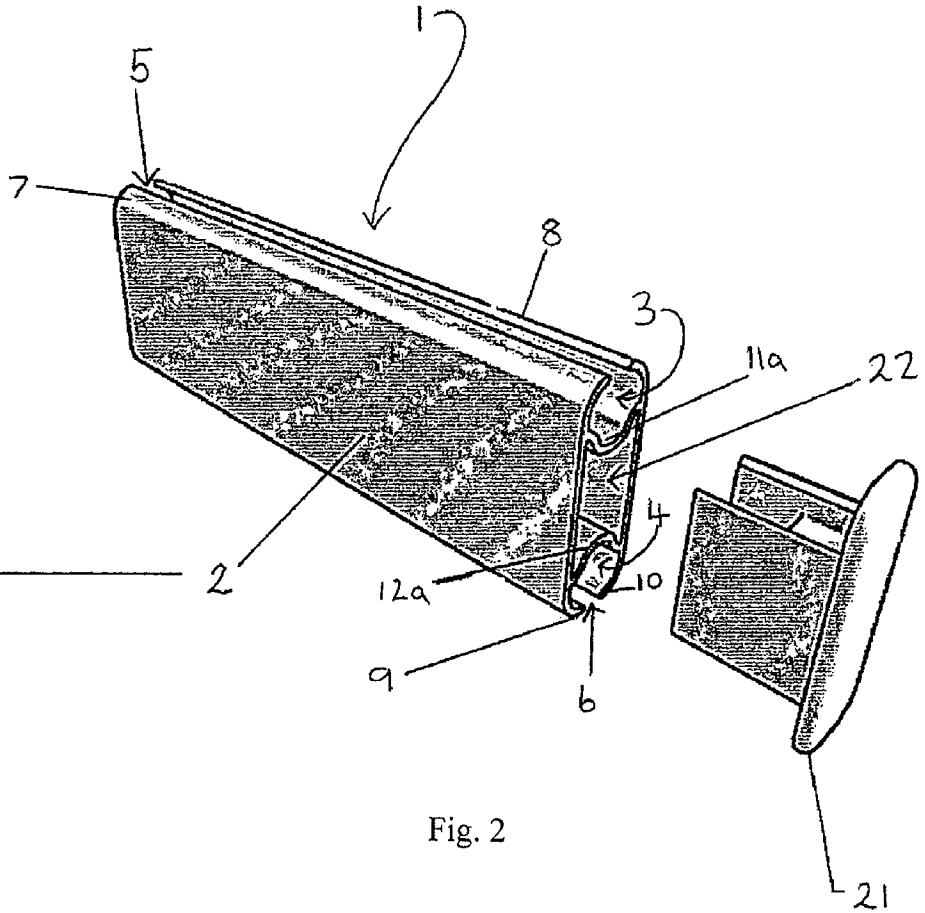
FIG. 2 is a perspective view of the bottom bar and end cap shown in FIG. 1 with the end cap off.
Figure 1:
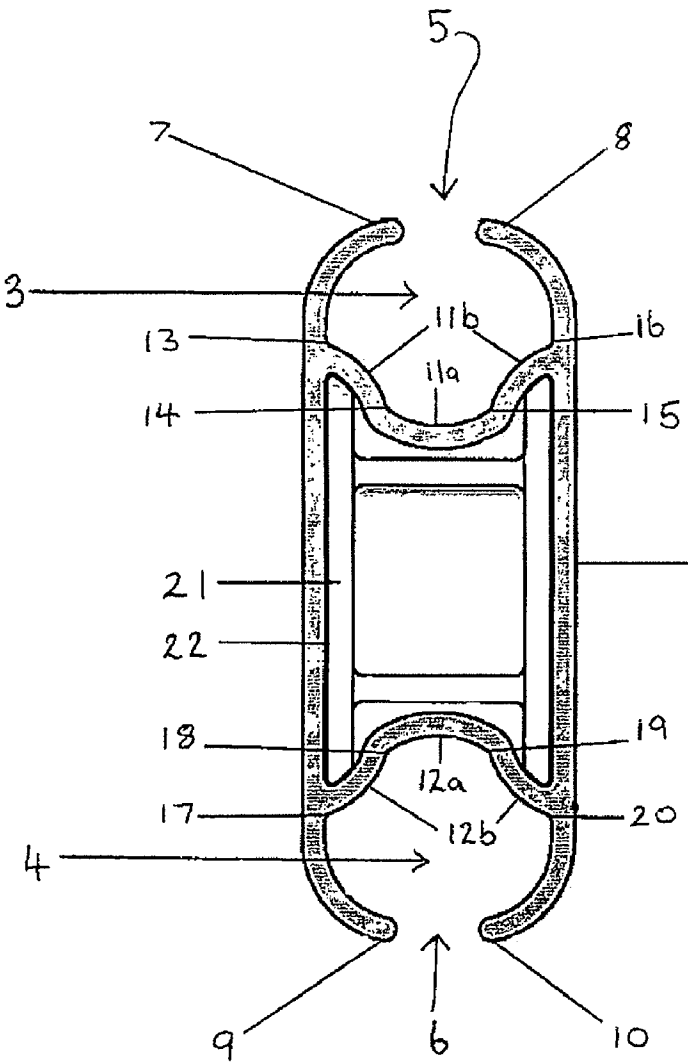
FIG. 1 is a cross-sectional view of a bottom bar with an end cap secured thereto according to the invention.

A bottom bar 1 according to the invention is shown in FIG. 1 and FIG. 2. The bottom bar 1 comprises an elongate body 2 having two axially extending slots, a top slot 3 and a bottom slot 4, each slot 3, 4 defining top and bottom openings 5, 6 for receiving blind material (not shown), the openings 5, 6 being of different respective widths, and the slots 3, 4 being of channel section and each having two inwardly directed lips 7, 8, 9, 10 overhanging the channels to define the width of the openings available for receiving blind material. Each of the slots 3,4 includes a floor 11, 12 which can be divided into two portions 11*a*, 11*b*, 12*a*, 12*b*, wherein the middle portion of the floor of the slot 11*a*, 12*a* is at a greater distance from the respective opening 5, 6 than the end portions of the floor of the slot 11*b*, 12*b*. The middle portion of the floor of the slots 11*a*, 12*a* is concave relative to the respective opening 5, 6 and the end portions of the floor of the slot 11*b*, 12*b* are convex. All of the corners within the channels 13, 14, 15, 16, 17, 18, 19, 20 define an angle which is greater than 90 degrees.

An end cap 21 attaches to the distal end of the bottom bar and is located within a channel 22 running the length of the bottom bar located between the slots 3, 4. The end cap 21 defines an end plate for the slots 3 and 4.

The invention claimed is:

1. A fabric receiving element for a blind assembly, the fabric receiving element having at least two axially extending slots, each slot defining an opening for receiving blind material, the openings being of different respective widths, each slot including a floor opposite the opening, wherein the floor includes a middle portion extending between first and second end portions, wherein the middle portion of the floor of the slot is at a greater distance from the opening than the first and second end portions of the floor of the slot, and wherein the entire middle portion of the floor has a continuous concave curvature, relative to the opening, from the first end portion to the second end portion.

2. A fabric receiving element according to claim 1, wherein the end portions of the floor of the slot are convex.

3. A fabric receiving element according to claim 1, wherein the slots are of channel section and have two inwardly directed lips overhanging the channel to define the width of the opening available for receiving blind material.

4. A fabric receiving element according to claim 1, wherein all of the corners within the slot define an angle which is greater than 90 degrees.

5. A fabric receiving element according to claim 1, wherein the slot is substantially without joined surfaces.

6. A fabric receiving element according to claim 1, wherein the openings differ in width by about 0.5 to 3 mm.

7. A fabric receiving element according to claim 1, wherein the end portions of the floor of the slot are convex and wherein the slots are of channel section and have two inwardly directed lips overhanging the channel to define the width of the opening available for receiving blind material.

8. A roller blind assembly, comprising a fabric receiving element as claimed in claim 1 and blind material.

9. A fabric receiving element according to claim 1, wherein the fabric receiving element is a bottom bar.

10. A fabric receiving element according to claim 9, wherein the bottom bar has a weight per meter of from 200 g to 400 g.

* * * * *